United States Patent [19]

Douty et al.

[11] Patent Number: 4,678,121

[45] **Date of Patent: * Jul. 7, 1987**

[54] MULTIPLANE CONNECTOR SYSTEM

[75] Inventors: George H. Douty, Mifflintown; John M. Landis, Camp Hill, both of Pa.

[73] Assignee: AMP Incorporated, Harrisburg, Pa.

[ * ] Notice: The portion of the term of this patent subsequent to Jul. 6, 1999 has been disclaimed.

[21] Appl. No.: 624,151

[22] Filed: Jun. 25, 1984

Related U.S. Application Data

[63] Continuation-in-part of Ser. No. 505,151, Jun. 17, 1983, Pat. No. 4,506,940.

[51] Int. Cl.[4] ..... H01R 13/46

[52] U.S. Cl. ..... 439/610; 439/83; 439/660; 439/862

[58] Field of Search ..... 339/17 LC, 176 M, 143, 339/14 R, 99

[56] References Cited

U.S. PATENT DOCUMENTS

| | | | |
|---|---|---|---|
| 3,253,190 | 5/1966 | Evans | 317/101 |
| 4,337,989 | 7/1982 | Asick et al. | 339/143 R |
| 4,506,940 | 3/1985 | Asick et al. | 339/176 M |

*Primary Examiner*—Eugene F. Desmond
*Assistant Examiner*—Paula A. Austin
*Attorney, Agent, or Firm*—F. Brice Faller; Adrian J. LaRue; David L. Smith

[57] ABSTRACT

An intercard connector system is formed by header assembly mounted on a circuit board and receiving therein a connector assembly terminating a multiconductor shielded cable. The header assembly is surface mountable to produce a low profile while the connector assembly is arranged to have a low profile mating portion with first and second arrays of terminals which allow close mating center line spacing and somewhat wider insulation displacing center line termination.

5 Claims, 8 Drawing Figures

MULTIPLANE CONNECTOR SYSTEM

This is a continuation-in-part of U.S. Application Ser. No. 505,151, filed 6-17-83, now U.S. Pat. No. 4,506,940.

The present invention relates to a multiplane connector and in particular to a shielded embodiment thereof.

The current state of the electronics technology requires the maximum number of interconnects in the minimum amount of space. The connectors hereofore available have not been able to fulfill these requirements satisfactarily, particularly when it comes to a shielded version.

The present invention concerns an interconnect system which includes a header assembly housing a pin carrying header or multiplane connector which is mounted on a circuit board or the like and which includes grounding hardware. An input/output connector carries a plurality of terminals each of which has a first end matable with pins in the header and an opposite end which is profiled for gang termination with conductors of a multiconductor cable.

The present invention will be described by way of example with reference to the accompanying drawings in which.

Figures 1, 2:
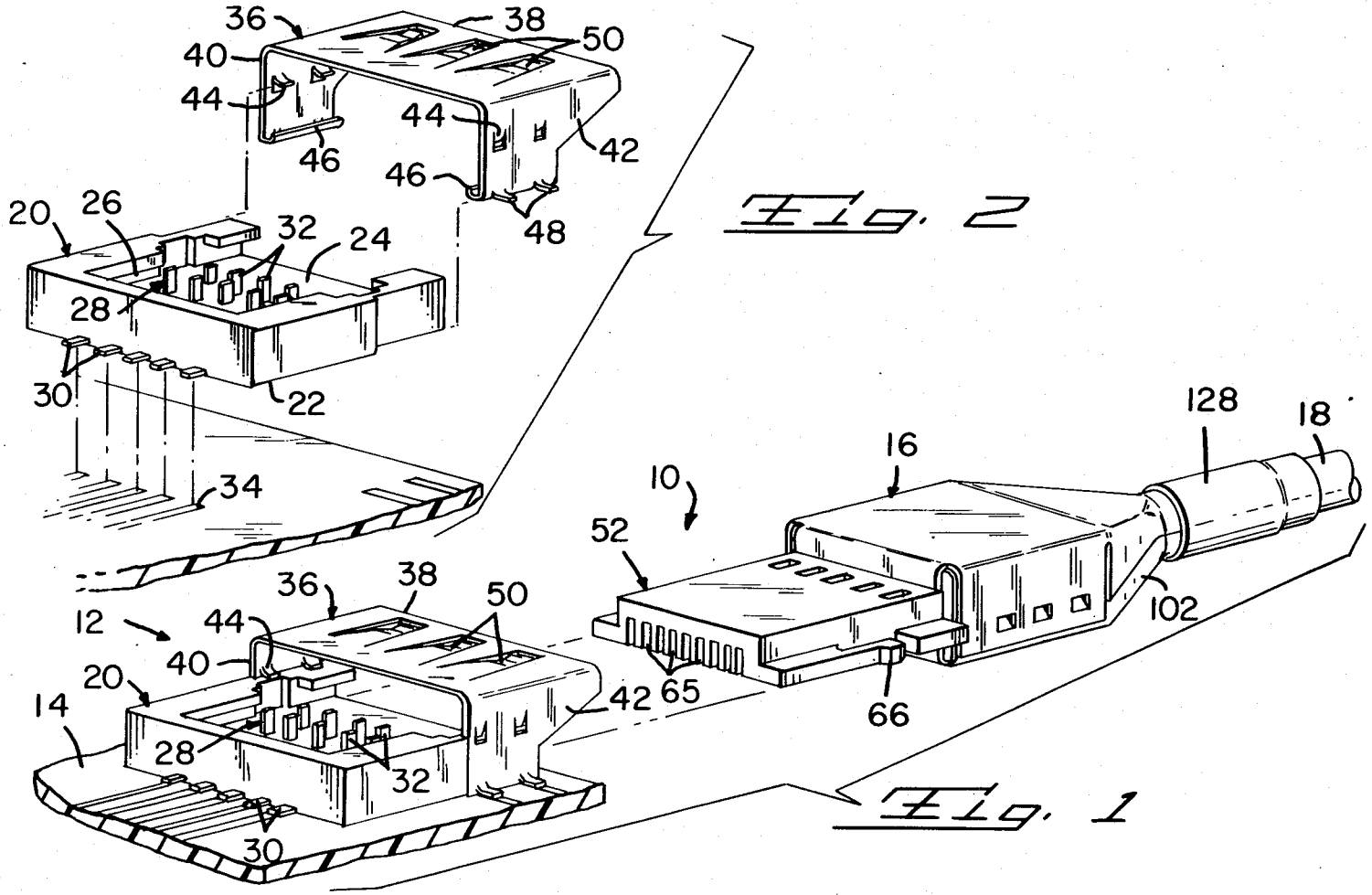
FIG. 1 is a perspective of the subject invention in an unmated condition.
FIG. 2 is an exploded perspective view of the header of the present invention.

The subject multiplane connector system 10 has a header assembly 12 mounted on a circuit board 14 and a connector assembly 16 terminating a shielded multiconductor cable 18.

Turning first to the header assembly 12, and with reference to FIG. 2, the header assembly 12 is formed by a housing 20 of rigid insulative material having a board engaging face 22 and an oppositely directed mating face 24 within a connector receiving cavity profiled to receive a mating connector 16 in a direction parallel to the mating face 24 26. A plurality of contacts 28 are fixedly mounted in the housing 20, each with a first end 30 projecting from the board engaging face 22 and a second end 32 projecting from the mating face 24. The ends 30 are spaced to engage the pads 34 on the circuit board in a surface mounting fashion. The header assembly 12 also includes a channel shaped metal ground shell 36 having a top portion 38 and a pair of depending sidewalls 40, 42 each with an inwardly directed housing engaging flanges 44, 46 and with pad engaging tabs 48 to engage respective pads 34 of the circuit board. The ground shell 36 also includes a plurality of resilient arms 50 which are inwardly directed to engage the connector 16 and tabs 48 for surface mount assembly on circuit board 14. They could, of course, have any known configuration such as a compliant pin for engaging a conductive hole in the circuit board.

Figure 3:
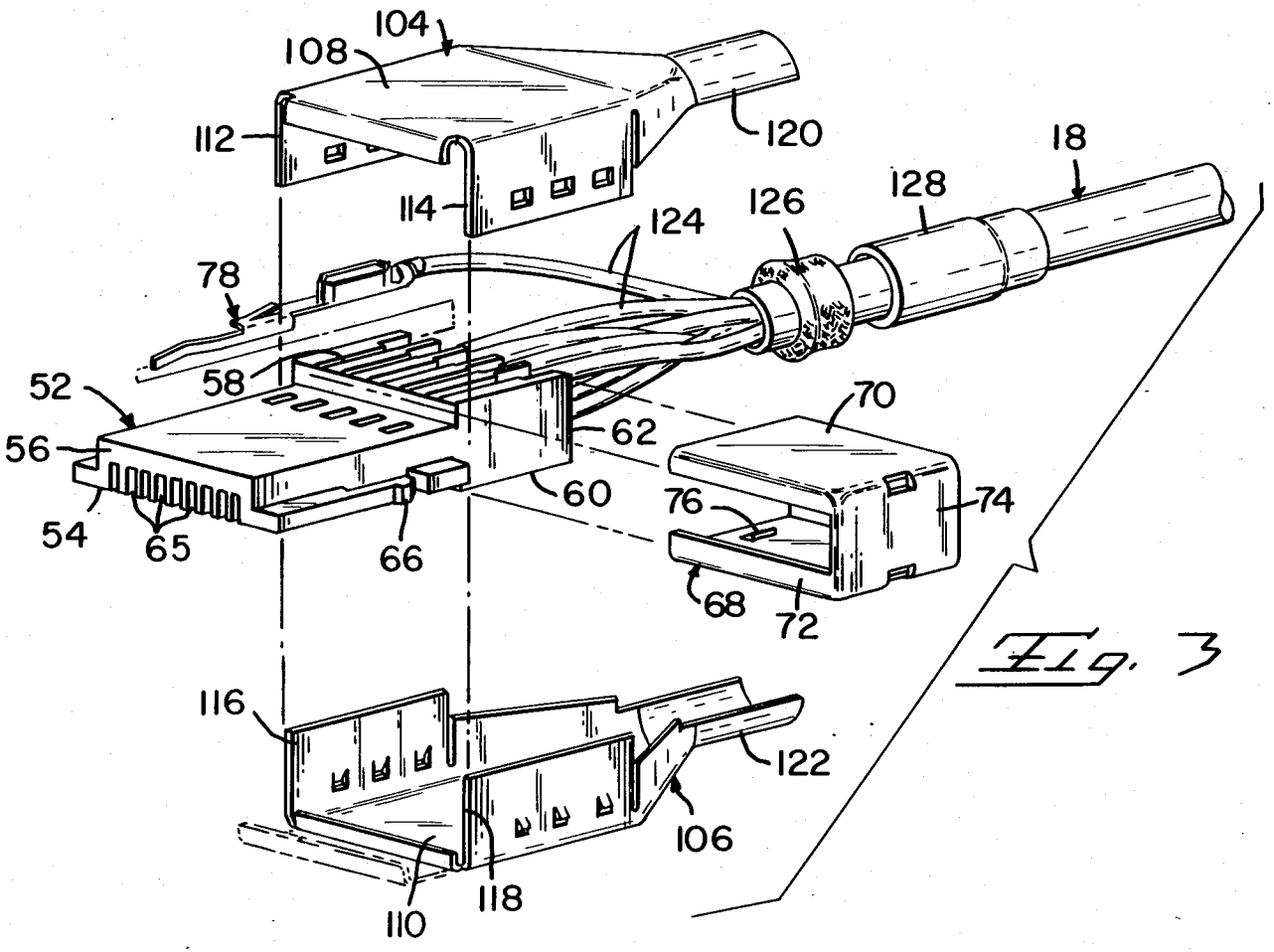
FIG. 3 is an exploded perspective view of the connector according to the present invention.
Figure 4:
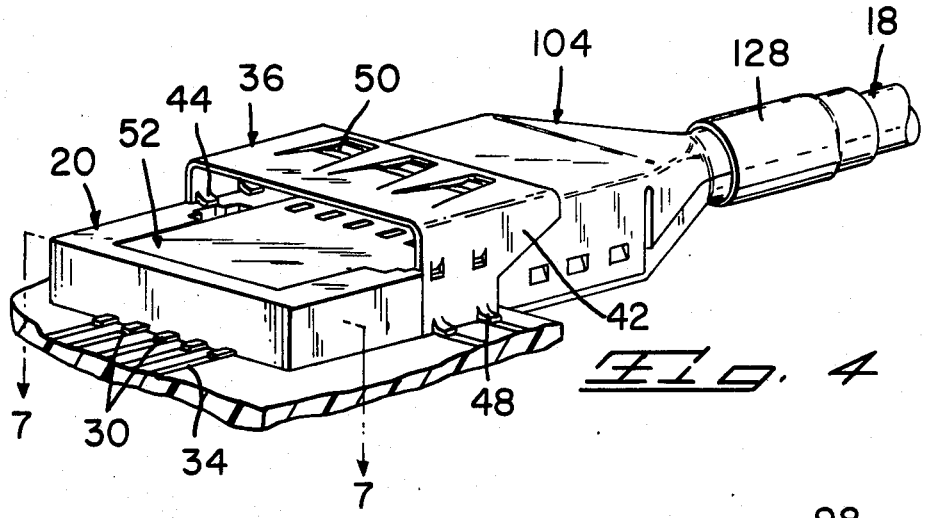
FIG. 4 is a perspective view, similar to FIG. 1, showing the subject invention in a mated condition.

The connector 16 is best illustrated in FIG. 3 and includes a housing 52 of rigid insulative material having a downwardly directed mating surface 54 toward first end 56 and oppositely directed channels 58, 60 toward opposite end 62. The channels 58, 60 connect to slots 65 on the mating surface 54 through terminal passages 64 Adjacent slots 65 extend to channels 58 and 60 on opposite sides while alternate slots 65 extend to channels 58 or 60 on the same side. The housing 52 also includes integral latching means 68. A separate cover 66 formed by channel shaped top and bottom walls 70, 72 joined at one end by wall 74 encloses terminal cavities 58, 60 from one side of housing 52. The cover 68 also includes at least one inwardly directed lug 76 to secure it to the housing 52.

Figure 5:
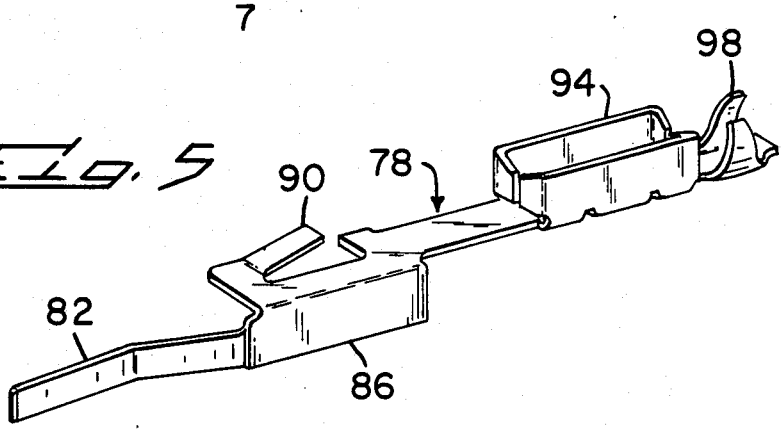
FIG. 5 is a perspective view of a terminal from the top row of terminals in the subject connector.
Figure 6:
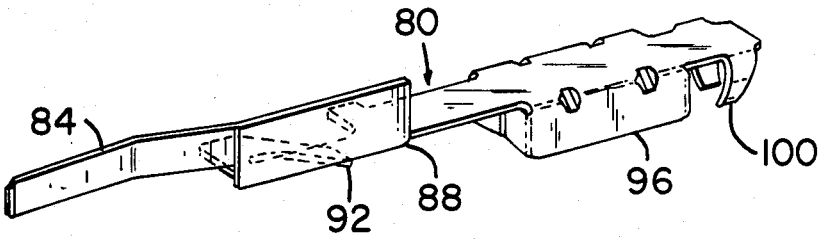
FIG. 6 is a perspective view of a terminal from the bottom row of terminals in the subject connector.
Figure 7:
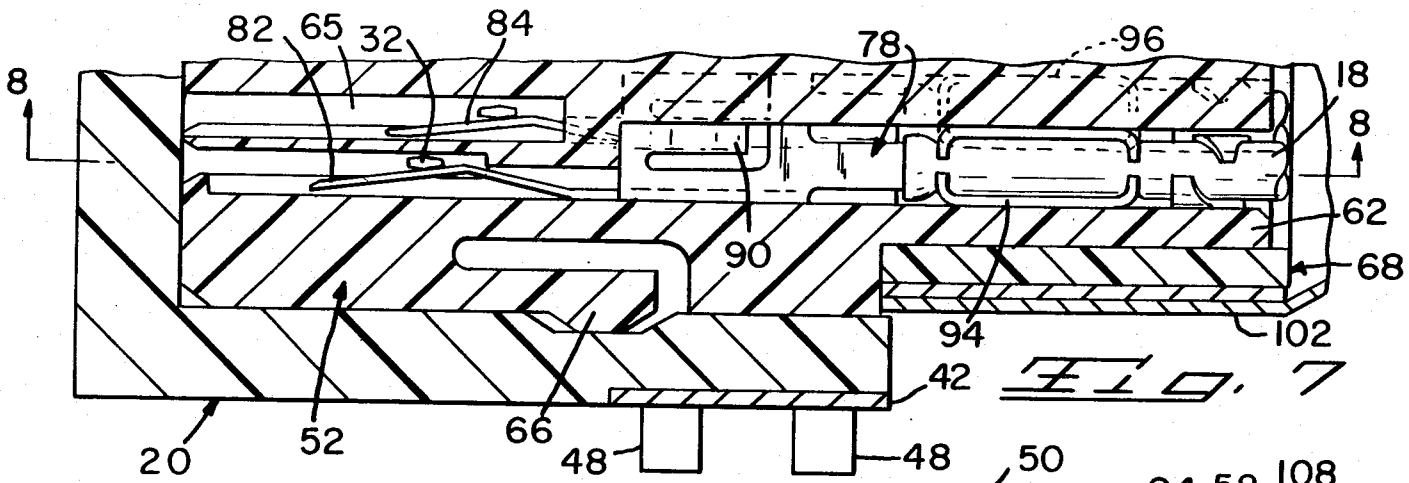
FIG. 7 is a partial section taken along line 7—7 of FIG. 4.
Figure 8:
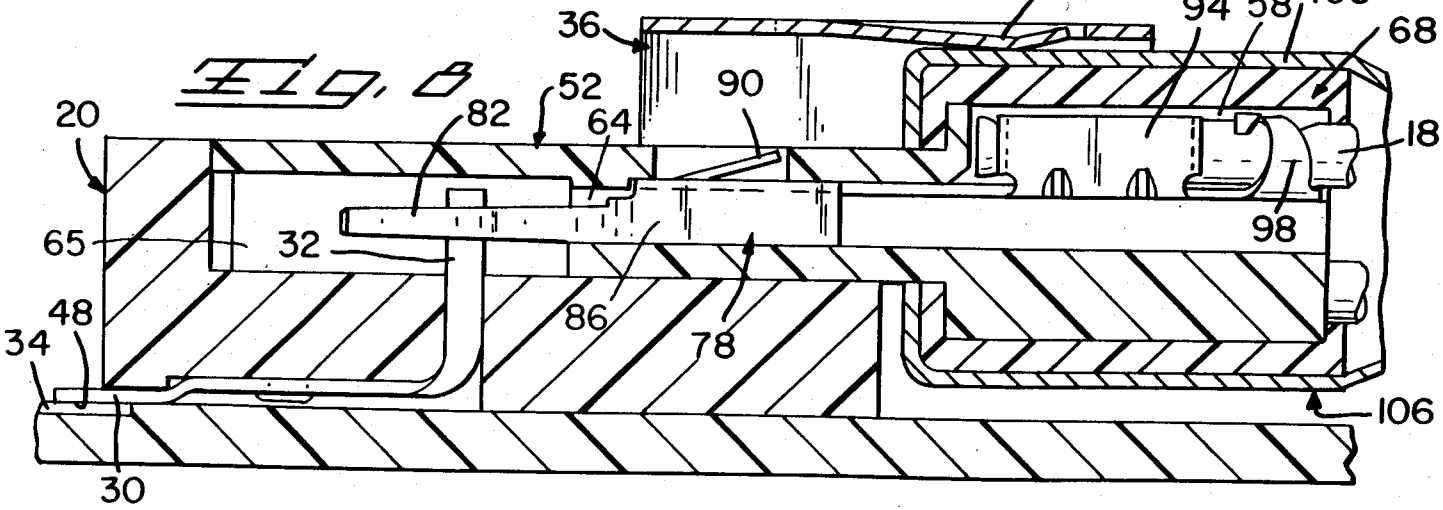
FIG. 8 is a partial section taken along line 8—8 of FIG. 7.

The terminals of the present invention are shown in detail in FIGS. 5 and 6 as first and second terminals 78, 80. The terminals 78, 80 are structurally arranged to facilitate reception in respective channels 58, 60 of the housing 52 from end 62. Terminals 78 have respective bodies 86 mounted in alternate passages 64, forwardly extending cantilever contact arms 82 in alternate slots 65, and rearwardly extending conductor engaging portions 94 in channels 58. Terminals 80 have respective bodies 88 in alternate passages 64, forwardly extending cantilever contact arms 84 in alternate slots 65, and rearwardly extending conductor engaging portions 96 in channels 60. The terminals 78, 80 have latching lances 90, 92 extending from respective bodies 86, 88 and crimp ears 98, 100 extending from the end adjacent the respective conductor engaging portion 94, 96.

Referring to FIGS. 1 and 3, the housing 52 is partially enclosed within a metal shield 102 having upper member 104 and lower member 106, the members having a wall portion 108, 110 and integral depending side walls 112, 114, 116, 118 which are interengaging and enclose the rear portion of the connector. They also have integral rearwardly directed portions 120, 122 which define a cable entry.

The shielded multiconductor cable 18 has a plurality of conductors 124 arranged within a shielding layer 126 which initially is drawn back, as shown in FIG. 3, and then extends over the cable entry defined by portions 120, 122 and is crimped thereto by a crimp ring 128.

The terminals 78, 80 of the present invention are preferably stamped and formed from multigage stock, the thicker portion of which is used for the insulation displacing portions 94, 96 and crimp ear portion 98, 100 of the terminal and the thinner portion for the single cantilever beam 82, 84. The arrangement of the terminals in the housing is such that it allows the cantilever beams forming the contact arms to be on close center lines while allowing the termination portion in each row of channels 58 or 60 to be on twice the centerline spacing of the contact arms.

The present invention has a number of advantages including the surface areas of the electrical terminals are small so that plating of gold or the like can be of very limited amounts. It also has a single piece plastic cover. The header portion and its associated grounding hardware can be installed on a circuit board in a single operation.

We claim:

1. A connector system comprising:

a header member having a mating face in a connector receiving cavity profiled to receive a mating connector in a direction parallel to said mating face and a plurality of contacts each with one end extending from the mating face, a connector member comprising a housing having a front mating end profiled for reception in said cavity, a rear terminating end, and a plurality of terminal passages extending therebetween, said mating end having a mating surface for reception against said mating face, said passages opening at said mating end as a plurality of parallel slots on said mating surface and at said terminating end as a plurality of parallel channels on opposite sides thereof, adjacent slots extending to channels on opposite sides thereof, alternate slots extending to channels on the same side, said connector member further comprising a plurality of terminals in respective passages, each terminal having a conductor engaging portion in a respective channel and a contact engaging portion in a respective slot, said slots being spaced to receive respective contacts.

2. A connector assembly as in claim 1 wherein said header further comprises a circuit board engaging face oppositely directed from said mating face, said assembly further comprising:

a channel shaped metal ground shell having a top portion parallel to said mating face and a pair of depending sidewalls having means for engaging said housing and means for engaging said circuit board, metal shield means at least partially enclosing said connector member, said shield means having means for engaging the shielding of a multiconductor shielded cable.

3. A connector assembly as in claim 2 wherein said channel shaped metal ground shell further comprises a plurality of resilient arms stamped from said top portion for engaging the shield means on said connector member.

4. A connector assembly as in claim 1 wherein said terminals each comprise a body portion received in a respective passage and a resilient cantilever arm extending forwardly from said body portion into a respective slot.

5. A connector assembly as in claim 4 wherein said terminals are stamped and formed from multigage stock having a thinner portion, the thinner portion being used for the resilient cantilever arms.

* * * * *